US012398624B2

(12) United States Patent
Zhong et al.

(10) Patent No.: US 12,398,624 B2
(45) Date of Patent: Aug. 26, 2025

(54) SELF-ENERGIZING SEAL FOR EXPANDABLE LINER HANGER

(71) Applicant: Halliburton Energy Services, Inc., Houston, TX (US)

(72) Inventors: Xiaoguang Allan Zhong, Singapore (SG); Yian Zhao, Singapore (SG); Shobeir Pirayeh Gar, Carrollton, TX (US); Chee Sing Kelvin Loh, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/350,222

(22) Filed: Jul. 11, 2023

(65) Prior Publication Data

US 2025/0020045 A1 Jan. 16, 2025

(51) Int. Cl.
*E21B 43/10* (2006.01)

(52) U.S. Cl.
CPC ..... *E21B 43/103* (2013.01)

(58) Field of Classification Search
CPC ..... E21B 43/103
See application file for complete search history.

(56) References Cited

U.S. PATENT DOCUMENTS

| | | | |
|---|---|---|---|
| 2,152,628 | A | 4/1939 | Gauthey |
| 4,663,513 | A | 5/1987 | Webber |
| 4,832,125 | A | 5/1989 | Taylor |
| 4,919,460 | A | 4/1990 | Milberger et al. |
| 5,303,518 | A | 4/1994 | Strickland |
| 5,542,473 | A | 8/1996 | Pringle et al. |
| 6,029,748 | A | 2/2000 | Forsyth et al. |
| 6,098,717 | A | 8/2000 | Bailey et al. |
| 6,378,606 | B1 | 4/2002 | Swor et al. |
| 6,793,022 | B2 | 9/2004 | Vick et al. |
| 7,360,592 | B2 | 4/2008 | McMahan |
| 9,255,467 | B2 | 2/2016 | Thomson et al. |
| 9,316,084 | B2 | 4/2016 | Carter et al. |
| 9,580,981 | B2 | 2/2017 | Zhong et al. |
| 9,695,651 | B2 | 7/2017 | Gorrara et al. |

(Continued)

FOREIGN PATENT DOCUMENTS

| | | |
|---|---|---|
| EP | 0289108 | 3/1992 |
| EP | 2789791 | 10/2014 |

(Continued)

OTHER PUBLICATIONS

"U.S. Appl. No. 17/750,662 Office Action", Oct. 5, 2023, 24 pages.

(Continued)

*Primary Examiner* — Steven A MacDonald
(74) *Attorney, Agent, or Firm* — DeLizio, Peacock, Lewin & Guerra LLP

(57) ABSTRACT

Embodiments of a system, method, and apparatus for a liner hanger installed into a wellbore are disclosed herein. In one embodiment, an apparatus comprises a liner hanger to be positioned within a wellbore, wherein the liner hanger comprises, at least one spike to secure the liner hanger to a casing within the wellbore, wherein an outer diameter of the at least one spike includes a seal recess; and a seal object to be positioned in the seal recess to form a seal with the casing when the liner hanger is hanging on the casing.

20 Claims, 8 Drawing Sheets

(56) References Cited

U.S. PATENT DOCUMENTS

| | | | | |
|---|---|---|---|---|
| 9,752,400 | B2 | 9/2017 | Hazelip et al. | |
| 10,337,298 | B2 | 7/2019 | Braddick | |
| 11,118,434 | B2 | 9/2021 | Hazelip et al. | |
| 11,156,065 | B2 | 10/2021 | Zhong et al. | |
| 11,215,012 | B2 | 1/2022 | Chen et al. | |
| 11,225,000 | B2 | 1/2022 | Yu et al. | |
| 11,248,450 | B2 | 2/2022 | Hazelip | |
| 11,248,451 | B2 | 2/2022 | Sevadjian et al. | |
| 11,359,465 | B2 | 6/2022 | Williams | |
| 11,377,934 | B1 | 7/2022 | Gar et al. | |
| 2001/0045289 | A1 | 11/2001 | Cook et al. | |
| 2001/0047866 | A1 | 12/2001 | Cook et al. | |
| 2002/0014339 | A1 | 2/2002 | Ross | |
| 2002/0139540 | A1 | 10/2002 | Lauritzen | |
| 2003/0042022 | A1 | 3/2003 | Lauritzen et al. | |
| 2003/0047322 | A1 | 3/2003 | Maguire et al. | |
| 2003/0094768 | A1 | 5/2003 | Kamiya et al. | |
| 2004/0149418 | A1* | 8/2004 | Bosma | E21B 36/00 164/98 |
| 2004/0244994 | A1 | 12/2004 | Jackson et al. | |
| 2005/0011650 | A1 | 1/2005 | Harrall et al. | |
| 2005/0052019 | A1 | 3/2005 | Schroeder | |
| 2006/0237188 | A1 | 10/2006 | McMahan | |
| 2007/0257486 | A1 | 11/2007 | Filippov et al. | |
| 2012/0097384 | A1 | 4/2012 | Valencia et al. | |
| 2012/0205091 | A1 | 8/2012 | Turley et al. | |
| 2012/0312542 | A1 | 12/2012 | Varghese et al. | |
| 2013/0248209 | A1* | 9/2013 | Watson | E21B 43/106 166/242.6 |
| 2014/0000911 | A1 | 1/2014 | Gorrara et al. | |
| 2014/0008082 | A1 | 1/2014 | O'Brien et al. | |
| 2014/0020911 | A1 | 1/2014 | Martinez | |
| 2014/0174763 | A1 | 6/2014 | Zhong et al. | |
| 2015/0011650 | A1 | 1/2015 | Bartos et al. | |
| 2015/0068733 | A1 | 3/2015 | Dilber et al. | |
| 2015/0218903 | A1 | 8/2015 | Sellers, Jr. et al. | |
| 2016/0053591 | A1 | 2/2016 | Hallundbaek et al. | |
| 2016/0090801 | A1 | 3/2016 | Hazelip et al. | |
| 2016/0326830 | A1 | 11/2016 | Hallundbæk et al. | |
| 2016/0356131 | A1 | 12/2016 | Humphrey et al. | |
| 2016/0369587 | A1 | 12/2016 | Staehr | |
| 2017/0022775 | A1 | 1/2017 | Spitz et al. | |
| 2018/0045016 | A1 | 2/2018 | Radtke et al. | |
| 2018/0112486 | A1 | 4/2018 | Potts et al. | |
| 2018/0135369 | A1 | 5/2018 | Parekh et al. | |
| 2019/0218873 | A1 | 7/2019 | Davis et al. | |
| 2019/0316434 | A1 | 10/2019 | Davies et al. | |
| 2019/0330943 | A1* | 10/2019 | Givens | E21B 23/01 |
| 2020/0149375 | A1 | 5/2020 | Bermudes et al. | |
| 2020/0173248 | A1 | 6/2020 | Yee et al. | |
| 2020/0332604 | A1 | 10/2020 | Whiddon et al. | |
| 2020/0370383 | A1 | 11/2020 | Hazelip | |
| 2021/0010353 | A1 | 1/2021 | Hazelip et al. | |
| 2021/0011576 | A1 | 1/2021 | Suto et al. | |
| 2021/0020263 | A1 | 1/2021 | Pasini et al. | |
| 2021/0087902 | A1 | 3/2021 | Saeed | |
| 2021/0115764 | A1 | 4/2021 | Zhong et al. | |
| 2021/0140263 | A1 | 5/2021 | Dockweiler et al. | |
| 2021/0310339 | A1 | 10/2021 | Williams | |
| 2022/0145712 | A1 | 5/2022 | Bermudez et al. | |
| 2023/0003097 | A1 | 1/2023 | Vasques | |
| 2023/0220743 | A1 | 7/2023 | Vasques | |
| 2023/0349270 | A1 | 11/2023 | Furlong et al. | |
| 2023/0374890 | A1 | 11/2023 | Zhong et al. | |
| 2023/0407730 | A1 | 12/2023 | Zhong et al. | |
| 2024/0117716 | A1 | 4/2024 | Zhong et al. | |
| 2024/0151123 | A1 | 5/2024 | Loh et al. | |
| 2024/0175332 | A1 | 5/2024 | Silverberg et al. | |
| 2024/0229614 | A1 | 7/2024 | Chevallier et al. | |

FOREIGN PATENT DOCUMENTS

| | | |
|---|---|---|
| EP | 3667014 | 6/2020 |
| WO | 2011151139 | 12/2011 |
| WO | 2020185208 | 9/2020 |
| WO | 2022177939 | 8/2022 |

OTHER PUBLICATIONS

"TIW XPak System Hanger Packer", https://www.tiwoiltools.com/xpak-liner-hanger.html,, 2018, 6 pages.
"U.S. Appl. No. 17/750,662 Office Action", Aug. 3, 2023, 10 pages.
Dutta, et al., "Additive Manufacturing by Direct Metal Deposition", Advanced Materials & Processes, May 2011, 4 pages.
Labudovic, et al., "A Three Dimensional Model for Direct Laser Metal Powder Deposition and Rapid Prototyping", Journal of Materials Science 38, 2003, pp. 35-49.
"PCT Application No. PCT/US2023/070087, International Search Report and Written Opinion", Apr. 2, 2024, 12 pages.
"PCT Application No. PCT/US2022/077934 International Search Report and Written Opinion", Jul. 11, 2023, 13 pages.
"PCT Application No. PCT/US2023/086224 International Search Report and Written Opinion", May 8, 2024, 8 pages.
"U.S. Appl. No. 17/750,662 Final Office Action", Apr. 25, 2024, 9 pages.
"U.S. Appl. No. 18/045,618 Office Action", Nov. 28, 2023, 15 pages.
"Metal Seal Design Guide", Parker Hannifin Corporation, https://www.parker.com/content/dam/Parker-com/Literature/Seal-Group/CSS-5129.pdf, 2013, 106 pages.
"O-Flex Metal Seal O-Rings", Technetics Group, https://technetics.com/products/o-flex-metal-seal/, 2023, 3 pages.
Zhong, et al., "Performance Evaluation of a Large Bore Expandable Liner Hanger for Field Operations in the Gulf of Mexico", Offshore Technology Conference held in Houston, Texas, USA, May 4-7, 2015., May 2015, 14 pages.
"U.S. Appl. No. 17/750,807 Final Office Action", May 28, 2024, 29 pages.
"U.S. Appl. No. 18/543,925 Non Final Office Action", Sep. 18, 2024, 18 pages.
"U.S. Appl. No. 17/750,807 Non-Final Office Action", Nov. 7, 2024, 27 pages.
"U.S. Appl. No. 18/543,925 Final Office Action", Feb. 3, 2025, 22 pages.

* cited by examiner

SELF-ENERGIZING SEAL FOR EXPANDABLE LINER HANGER

BACKGROUND

During wellbore operations, a liner may be "hung" onto a casing such that the liner supports an extended string of tubular below it. As used herein, "tubing string" refers to a series of connected pipe sections, casing sections, joints, screens, blanks, cross-over tools, downhole tools, and the like, inserted into a wellbore, whether used for drilling, work-over, production, injection, completion, or other processes. A tubing string may be run in and out of the casing, and similarly, tubing string can be run in an uncased wellbore or section of wellbore. Further, in many cases a tool may be run on a wireline or coiled tubing instead of a tubing string, as those of skill in the art will recognize.

Expandable liner hangers may generally be used to secure the liner within a previously set wellbore tubular (e.g., liner, casing or liner string). Expandable liner hangers may be "set" by expanding the liner hanger radially outward into gripping and sealing contact with the wellbore tubular. For example, expandable liner hangers may be expanded by use of hydraulic pressure to drive an expanding cone, wedge, or "pig," through the liner hanger. Other methods may be used, such as mechanical swaging, explosive expansion, memory metal expansion, swellable material expansion, electromagnetic force-driven expansion, etc.

BRIEF DESCRIPTION OF THE DRAWINGS

Embodiments of the disclosure may be better understood by referencing the accompanying drawings.

DESCRIPTION

Figure 1:
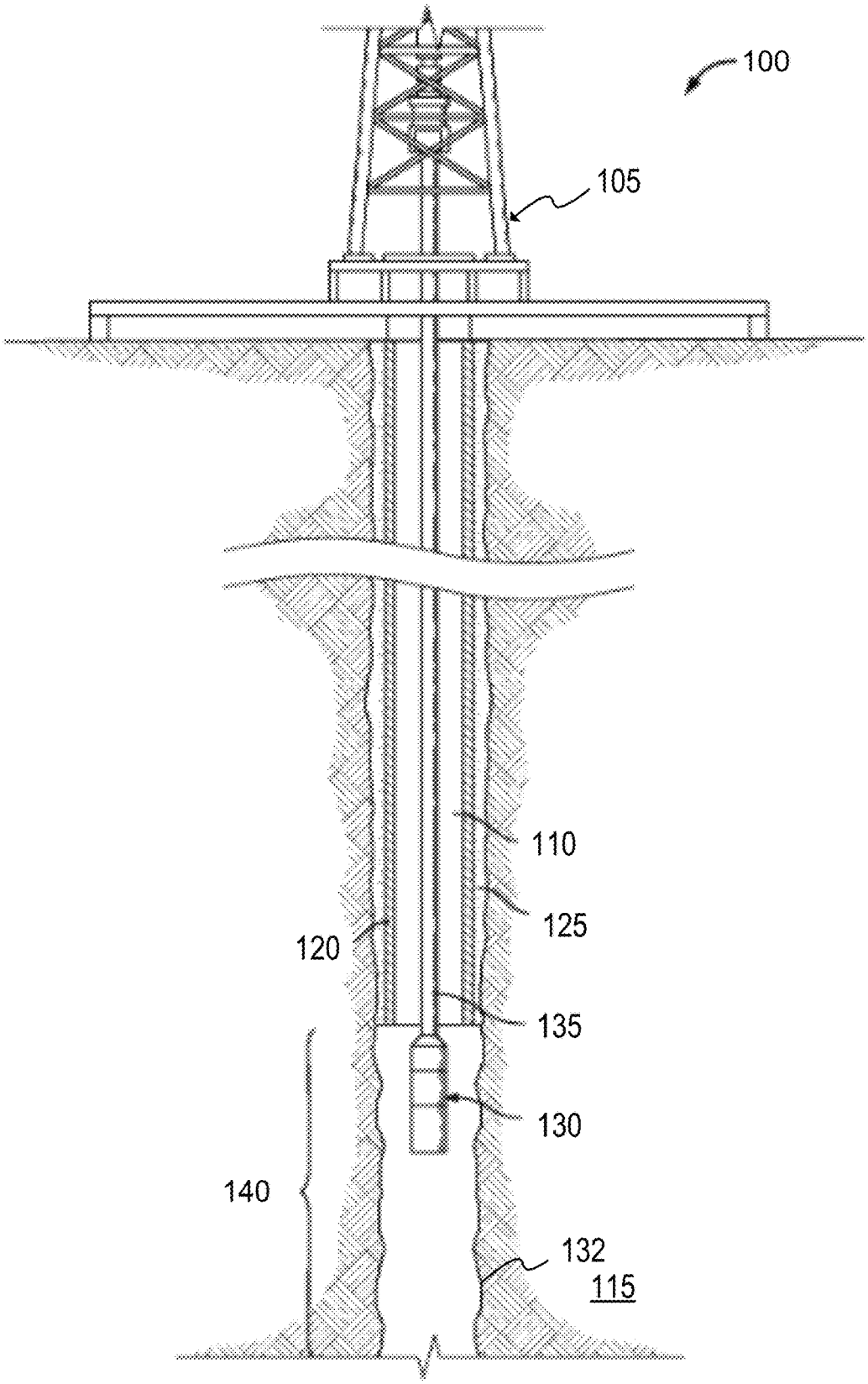
FIG. 1 illustrates one embodiment of a well system 100 designed, manufactured and/or operated according to one or more embodiments of the disclosure.

The description that follows includes example systems, methods, techniques, and program flows that embody aspects of the disclosure. However, it is understood that this disclosure may be practiced without these specific details. In some instances, well-known instruction instances, protocols, structures, and techniques have not been shown in detail in order not to obfuscate the description.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect." "engage," "couple." "attach," or any other like term describing an interaction between elements is not meant to limit the interaction to a direct interaction between the elements and may also include an indirect interaction between the elements described. Unless otherwise specified, use of the terms "up," "upper." "upward." "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

Expandable Liner Hangers (ELH) provide a robust and elegant design which has a strong record of success in the field for high pressure high temperature (HPHT) applications. Through plastic deformation of the hanger body, the metal spikes make firm contact with the casing inner diameter (ID) during the expansion process providing both anchoring and sealing capacity of the hanger. In many cases, a few short elastomer elements are added between the spikes to enhance the sealing performance to account for certain casings in downhole environments, such as, e.g., standard American Petroleum Institute (API) casings.

Current designs are facing challenges to seal the liner from extremely high annular pressure, especially for thick and high yield casing. The sealability of the metal spike is sensitive to dimension variation of the casing and the surface contact pressure between spikes and the casing is influenced by the maximum expansion force. More importantly, unlike most metal seal designs, the contact pressure between the spike and the casing ID will drop with the increase of annular pressure. The rubber elements, on the other hand, usually suffer from nibbling during expansion and the performance is considerably weakened under large temperature swings. In addition, the sour environment also limits choices for elastomers.

Several new concepts have been proposed to address these issues. Some seals which may be used rely on polymeric materials and or metal materials, which is not ideal for HPHT applications. The scalability of some spikes are limited by one or both of at the following two factors: 1) the inherent collapse strength of hanger body under combined load, which could lead to sudden opening of the clearance between a wellbore casing and hanger body outer diameter (OD); and 2) wear of the sealing surface under high compressive load.

Examples of an expandable liner hanger system and method disclosed herein include a standalone metal seal design for an ELH system to improve the sealing performance, and especially improve performance when there is pressure from below. In the examples provided herein, one feature of the liner hanger system includes a seal, such as a metal-to-metal (MTM) seal which can be energized annular pressure applied, i.e., the higher the applied annular pressure, the higher the sealing pressure. The solution provided herein accommodates extrusion gap increase from annular pressure, which cannot be achieved by previous ELH systems available. Another feature includes a proposed metal seal is that the seal gland (or recess) outer diameter (OD) may have a slope in an axial direction, with an upstream/uphole end of the recess gland OD larger than the downstream/downhole end OD of the gland, when the annular pressure is exerted downhole of the seal. When annular pressure is exerted uphole of the seal, the seal gland (or recess) outer diameter (OD) will similarly have a slope in an axial direction, with a downstream/downhole end of the recess gland OD larger than the upstream/uphole end OD of the gland This feature further enhances the self-energizing capability of the MTM seal.

In one example, a liner hanger to be positioned within a casing in a wellbore includes at least one spike to secure the liner hanger to the casing, wherein an outer diameter of the at least one spike includes a seal recess (or gland); and a seal object (seal) to be positioned in the seal recess to form a seal with the casing when the liner hanger is hanging on the casing. In some embodiments, the seal object may be an o-ring with at least one hole, slot, or opening on one side in order to introduce annular pressure from within the wellbore to energize the seal object. The o-ring may be metal and may be hollow and may be fitted between the hanger body ribs or spikes as grooves (e.g. dovetail groove). The height of the spikes/ribs is usually lower than the adjacent spikes and can be designed to control the initial compression of the seal at a desired value. The lowered ribs require less expansion force as well. After expansion, the metal seal object creates the initial sealing between the liner hanger and the casing or liner with high contact pressure. The seal recess may have an axial slope. When high annular pressure is applied, in this example from below/downhole of the hanger, the self-energized seal object will be activated in two ways. The seal object is designed such that the applied pressure will be vented into the structure inside the seal object to provide extra stiffness. A piston load on the seal will push it upwards. The bottom of the recess (or groove) is designed with an angled surface which causes a "jamming" effect that increases the contact pressure as the blow pressure below the spike/rib increases. In other examples, the high annular pressure may be applied from uphole/above the hanger, wherein the piston load will push the seal downwards. More detailed examples and embodiments are described below.

Example Embodiments

FIG. 1 illustrates one embodiment of a well system 100 designed, manufactured and/or operated according to one or more embodiments of the disclosure. The well system 100, in at least one embodiment, includes a wellbore 110 extending from a rig 105 through one or more hydrocarbon bearing subterranean formations 115. Further to the embodiment of FIG. 1, a wellbore tubular or casing 120 has been installed with cement 125 within the wellbore 110. The wellbore casing 120 may comprise many different materials and minimum yield strength, such as high-grade steel. In some embodiments, the wellbore tubular 120 may be the casing, or may be a liner, or may include both a casing and a liner. The wellbore 110 may also include an open hole portion 140 below the tubular 120.

Figure 3A:
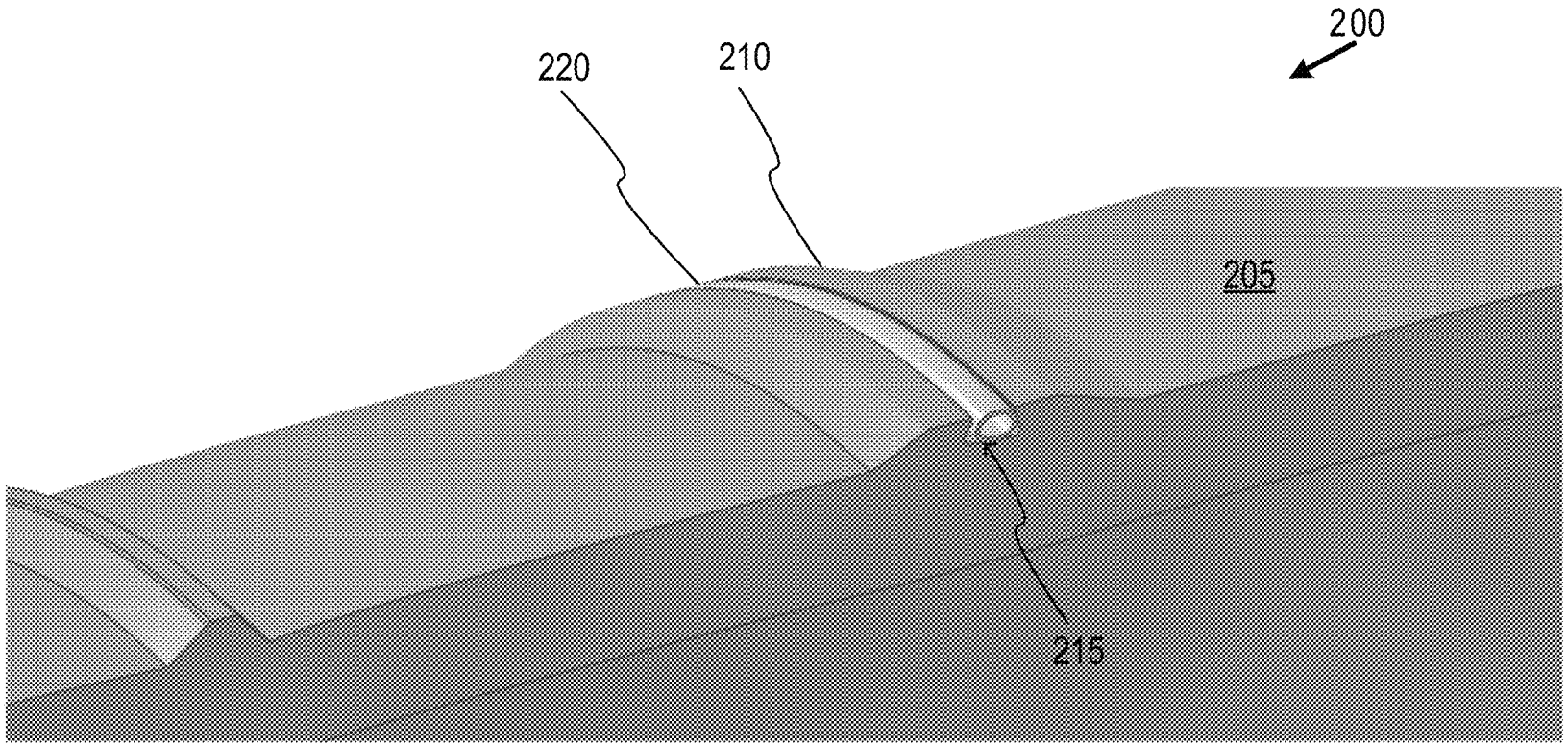
FIG. 3A-3C illustrate a partial section view of the liner hanger system of FIG. 2A-2D, according to some embodiments.

In the illustrated embodiment, a liner hanger system 130 (e.g., expandable liner hanger (ELH) system) and liner 132 are positioned within the wellbore 110. In this embodiment, the liner hanger system 130 is shown on a tool string 135. The liner hanger system 130, in at least one embodiment, includes a radially expandable liner hanger (or expandable tubular), and a plurality of continuous anchoring ridges or spikes on an outer surface of the expandable liner hanger, the anchoring spikes configured to engage with an inner surface of the casing 120. In the illustrated embodiment, the radially expandable liner hanger defines an interior passageway and an exterior surface. In accordance with one embodiment, the plurality of anchoring ridges or spikes includes at least one anchoring ridge proximate a distal or downhole end of the expandable liner hanger. The distal end anchoring ridge may have a recess or groove to form an opening in an outer surface thereof for receiving a self-energizing seal object, which in some embodiments may be a metal seal and can form a pressurized metal to metal (MTM) seal with the wellbore tubular 120. In accordance with one embodiment of the disclosure, the radially expandable liner hanger is configured to move from an initial state (as shown in FIG. 3A) wherein the one or more continuous anchoring ridges 145 are not in contact with the casing 120, to an expanded state (e.g., shown in FIG. 3B) wherein the one or more anchoring ridges or spikes are in gripping engagement with the casing 120.

A setting tool may be used to radially expand the liner hanger outward. Tool string 135 may convey the setting tool, liner hanger system 130, and liner 132 into the wellbore 110, conduct fluid pressure and flow, transmit torque, tensile and compressive force, etc. The setting tool may facilitate conveyance and installation of liner hanger system 130, in part by using the torque, tensile and compressive forces, fluid pressure and flow, etc., as may be delivered by tool string 135.

Even though FIG. 1 depicts a vertical wellbore, it should be understood by those skilled in the art that the liner hanger apparatus may be equally well suited for use in wellbore having other orientations including slanted wellbores, horizontal wellbores, multilateral wellbores or the like. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

As shown, the liner hanger system 130 may be hung, extending downhole from a lower end of a wellbore tubular, such as a liner or the wellbore tubular 120. An annulus may be created between the tubular 120 and the liner hanger system 130. In embodiments, the liner hanger system 130 can support additional wellbore casing, operational tubulars or tubing strings, completion strings, downhole tools, etc., for positioning at greater depths.

As used herein, the terms "tubular," "liner," and "casing" are used generally to describe tubular wellbore items, used for various purposes in wellbore operations. Tubulars, liners, and casings can be made from various materials (metal, plastic, composite, etc.), can be expanded or unexpanded as part of an installation procedure, and can be segmented or continuous. In some examples, the liner may be the casing, but may be an extra tubular layer within the casing. It is not necessary for a tubular, liner or casing to be cemented into position. Any type of tubular, liner, or casing may be used in keeping with the principles of the present disclosure.

Although the liner hanger system 130 is shown in a lower downhole end of the wellbore 110, many different configurations and relative positions of the wellbore tubular 120 and the liner hanger system 130 are possible.

Figure 2A:
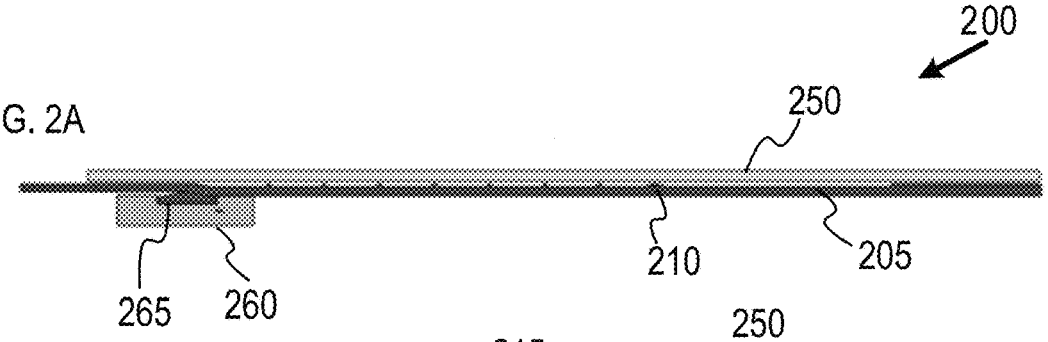
FIG. 2A-2D illustrate a side view of liner hanger system including a self-energizing seal for expandable liner hanger, according to some embodiments, shown in various stages of installation.
Figure 2B:
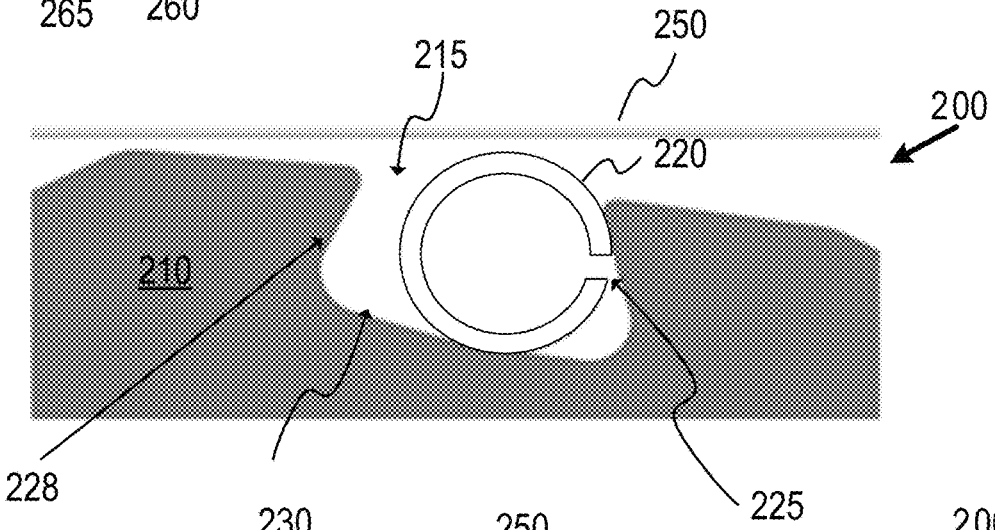

FIG. 2A-D illustrate a side view of liner hanger system 200 including a self-energizing seal for an expandable liner hanger. The liner hanger system 200 includes an expandable liner hanger 205 having at least one sealing spike 210 (or anchoring ridge) at one end thereof. As shown in FIG. 2B, the at least one sealing spike 210 may have a seal recess 215 (or groove) in an outer surface thereof. A seal object 220 is positioned in the seal recess 215 to form a seal with a wellbore tubular 250, such as a liner or the wellbore casing, when the liner hanger is installed into a wellbore and hanging on the wellbore tubular 250. The seal object 220 may be placed into the recess 215, and in some embodiments, may be attached or coupled into the recess 215, but may also be unsecured or free moving within the recess. If unsecured or freely placed into the recess, the recess 215 may have a larger opening at a top or outer surface thereof than a lower/inner surface 230 in order to maintain the seal object within the recess during run in hole and installation. The seal object may also be held in place by tension around the liner hanger 205, similar to tension experienced by, e.g., an elastic or stretchable band.

The seal recess 215 may include an inner recess surface 228 that is to face opposite of the surface of the wellbore tubular 250 to which the seal is to be formed, wherein the inner surface of the recess 215 has an angled slope, the inner recess surface comprising a lower end that is to be positioned lower in the wellbore and an upper end that is to be positioned higher relative to the lower end, wherein a lower distance from the lower end of the inner surface to the surface of the wellbore tubular 250 is greater than an upper distance from the upper end of the inner surface to the surface of the wellbore tubular 250.

Some embodiments of the expandable liner hanger 205 may include a plurality of additional spikes 240 (or anchoring ridges) along the outer surface thereof for additional support and engagement with the wellbore tubular 250. The additional spikes 240 may also provide sealing capabilities. FIG. 2A illustrates the liner hanger system 200 in a run-in hole position. To install the liner hanger system 200, a setting tool, nominally represented by setting tool 260 is positioned within the inner diameter of the expandable liner hanger 205. In this example, the setting tool 260 includes a cone 265. Once the expandable liner hanger 205 has reached a desired position within the wellbore, the setting tool 260 is run in a downhole direction. As the setting tool 260 moves downhole, the cone 265 engages an inner surface of the liner hanger 205, pushing it radially outward toward an inner surface of the wellbore tubular 250, engaging the plurality of additional spikes 240 and the at least one sealing spike 210 with the wellbore tubular 250, as shown in FIG. 2C.

Figure 2C:
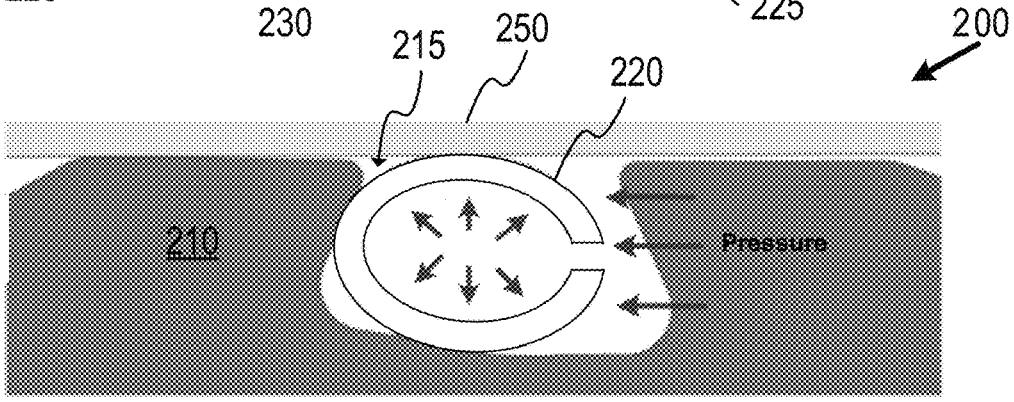

As shown in FIG. 2C, as the at least one sealing spike 210 engages the inner surface of the wellbore tubular 120, annular pressure from downhole enters the recess 215 and into an opening 225 of the sealing object 220. The opening 225 allows pressure from below the liner hanger 205 in the wellbore to be introduced into the seal object 220. The pressure applied from below (or downhole) of the sealing spike 210 energizes a seal to be formed between the sealing spike 210 and the wellbore tubular 250. In some embodiments, the at least one opening 225 of the seal object 220 faces toward a bottom of the wellbore after the seal object 220 is positioned in the seal recess 215. Some embodiments of the sealing object 220 may comprise metal and a metal-to-metal (MTM) seal is thereby energized under pressure. The higher the amount of applied pressure, the higher the sealing pressure. The resulting seal accommodates extrusion gap increase from annular pressure.

The seal recess 215 may comprise an upper sloping end that is to be positioned at an upper end of the wellbore and a lower sloping end that is to be positioned at a lower end of the wellbore, wherein a width of the lower sloping end is greater than a width of the upper sloping end. A bottom/radially inner surface 230 of the recess 215 may be sloped or angled radially downward which causes a "jamming" effect that increases the contact pressure within the recess 215 and within the sealing object 220 as the pressure below the sealing spike 210 increases. In some embodiments an outer diameter (OD) of the sealing object 220 may have a slope in an axial/downhole direction, with an upstream/uphole end OD larger than the downstream/downhole end OD of the sealing object 220. This feature may further enhance the self-energizing capability of the seal. In some embodiments, the bottom surface 230 may also be a flat surface, wherein the seal object 220 will still be jammed in the recess from the annular pressure.

Figure 2D:
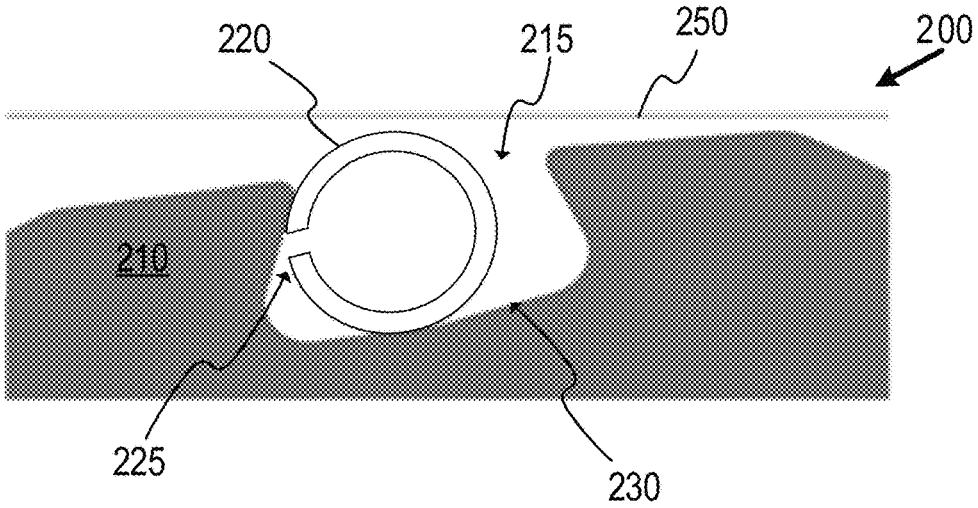

FIG. 2D illustrates an example embodiment wherein the annular pressure from the wellbore is exerted on the liner hanger system 200 from uphole/at an upper end of the liner hanger 200. In this example, the inner surface 230 is radially sloped away from the direction of the expected pressure and the opening 225 of the seal object 220 faces uphole.

The seal object 220 illustrated in FIG. 2A-2D is an o-ring, and may comprise metal. Although the sealing object is illustrated as an o-ring and having a circular and/or hollow interior, the cross-section of the seal object is not limited to a circular or hollow cross section. The seal object 220 may have a solid cross-section, which may generate different combinations of structural stiffness and spring back range. The internal pressure can be introduced to the seal in many ways as well, e.g. drilling tiny holes or slots on an O-ring without compromising the structural integrity. The geometry of the sealing object 220 may be altered and optimized for different scenarios. The dovetail sealing recess 215 (or groove) provides extra security to the seal but other shapes can be used as well. The width across a top/radially outer surface of the sealing spike 210 also affects the stiffness of the liner hanger 205, which is also an important feature to control the opening of the gap. Alternative shapes and configurations for the seal object are shown in FIG. 4A-4D.

Although the liner hanger system 200 is shown having only one sealing spike 210, and one seal object 220 in a recess 215 of the sealing spike 210, other embodiments may include a plurality of sealing spikes 210. In other embodiments, the at least one sealing spike 210 or plurality of sealing spikes 210 may include a plurality of recesses, each with a seal object positioned therein.

Figure 3B:
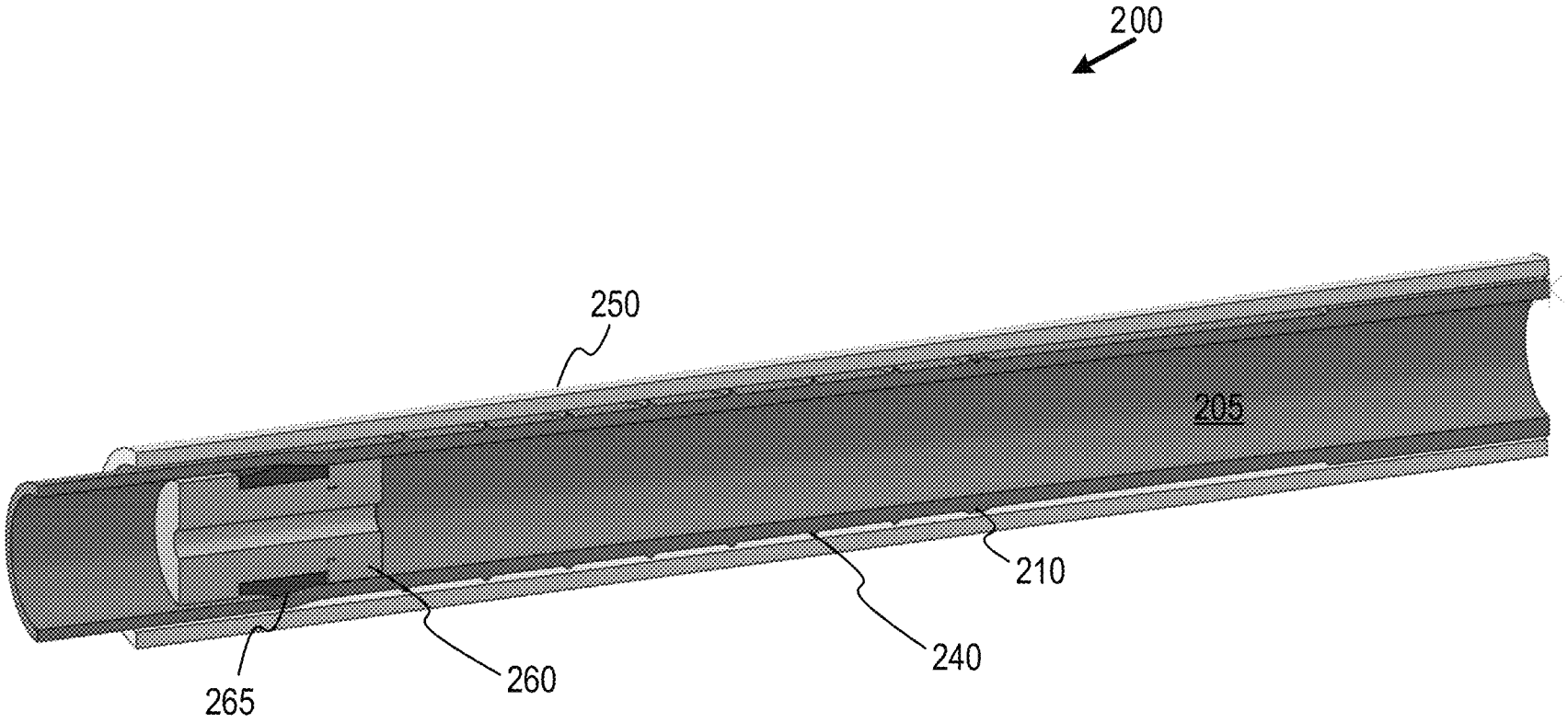
Figure 3C:
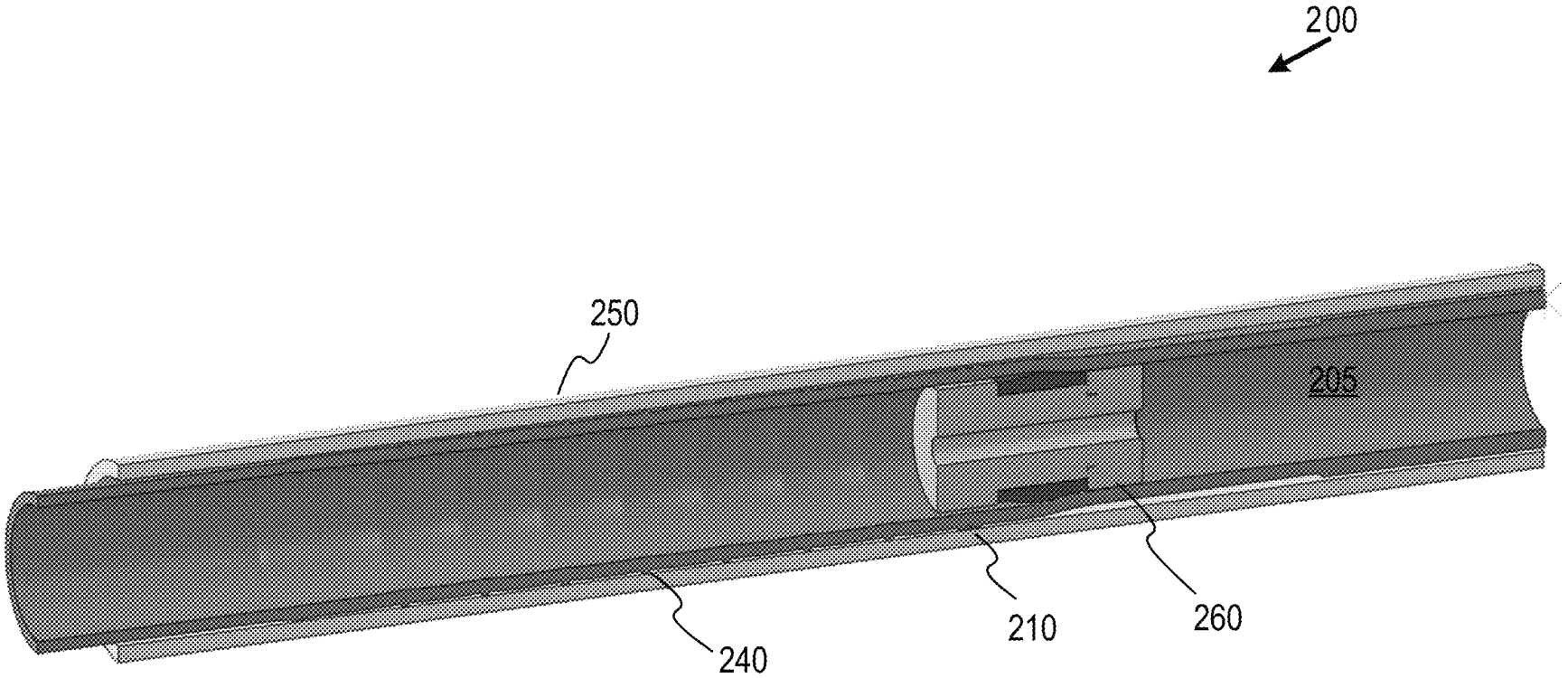

FIG. 3A-3C illustrate partial section views of the liner hanger system 200 of FIG. 2A-2D. FIG. 3A is a cutaway perspective view of the liner hanger 205, showing the at least one sealing spike 210 having the seal object positioned within the recess 215. FIG. 3B-3C are section views illustrating the liner hanger system 200 in different stages of installation. FIG. 3B illustrates the liner hanger system 200 shown when run in hole and into the wellbore tubular 250, wherein the setting tool 260 is positioned at an upper/uphole end of the liner hanger 205. FIG. 3C illustrates the setting tool 260 and cone 265 expanding the liner hanger 205, plurality of additional spikes 240, and at least one sealing spike 210 expanding radially outward into engagement with the wellbore tubular 250.

Figure 4A:
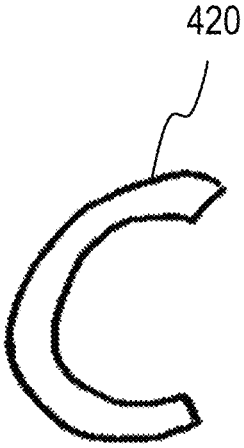
FIG. 4A-4D illustrate alternative seal objects which may be used with embodiments of a liner hanger system, according to some embodiments.
Figure 4B:
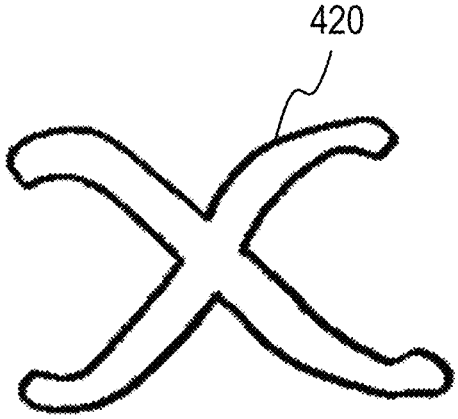
Figure 4C:
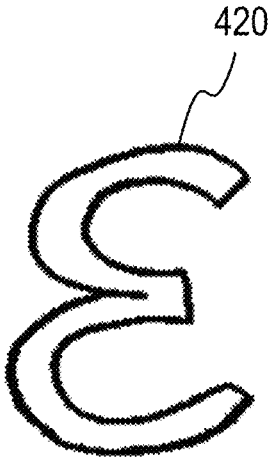
Figure 4D:
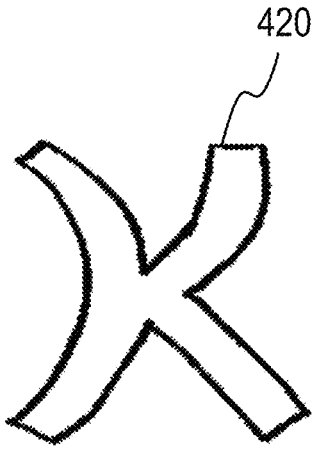

FIG. 4A-4D illustrate alternative shapes and configurations for a seal object 420 which may be used with liner hanger system instead of seal object 220 shown in FIG. 2A-3C. Each of the seal objects 420 may have non-closed cross section shape. In FIG. 4A the seal object has a C shape. In FIG. 4B the seal object has an X shape. In FIG. 4C the seal object has an E shape. In FIG. 4D the seal object has a K shape. While shapes of the seal objects 420 may have different geometries, openings 425 and/or slots of the seal objects 420 are preferably evenly distributed or substantially symmetrical. The different embodiments of the seal object 420 may be metal, but other materials may be used which may provide a seal and withstand the pressure which may be exerted from downhole. For example, the seal object 420 may comprise plastics, plastic based composites, and other materials which may withstand high temperatures and pressure which may be experienced downhole in a wellbore.

Figure 5A:
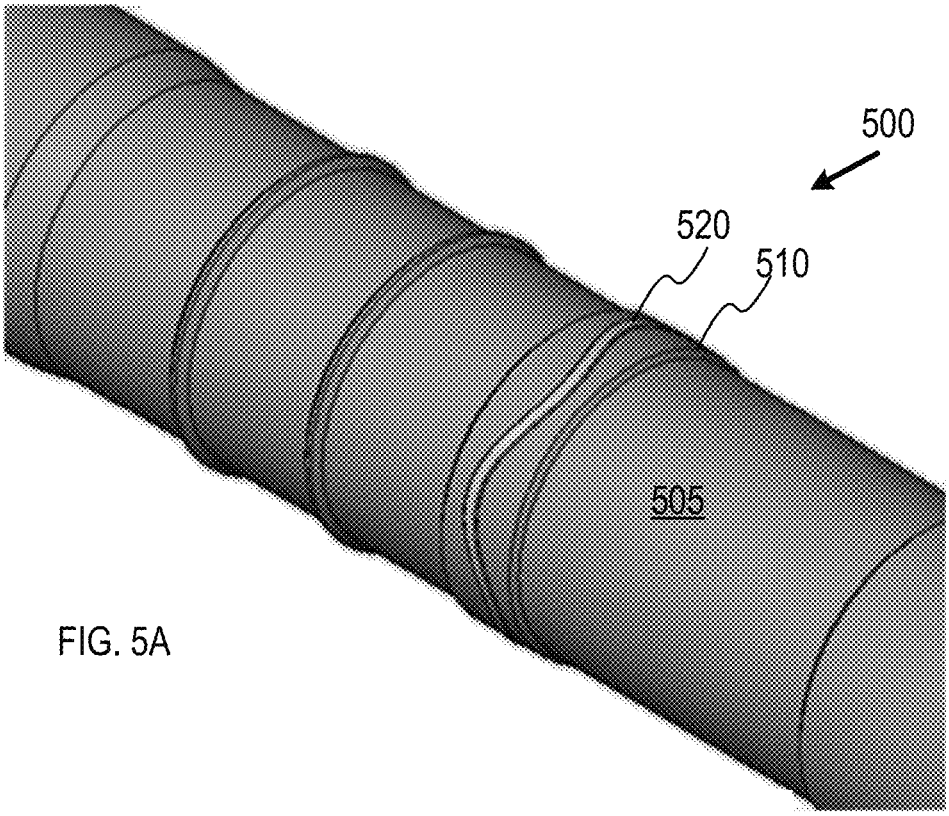
FIG. 5A-5B illustrate another embodiment of a liner hanger system, according to some embodiments.
Figure 5B:
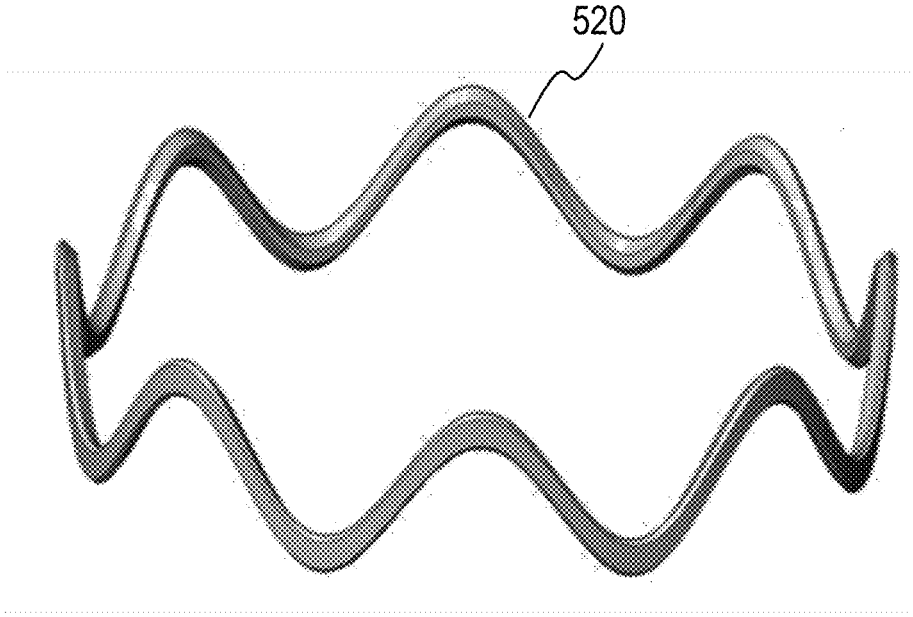

FIGS. 5A and 5B illustrate another embodiment of an expandable hanger liner system 500, according to some embodiments. In this embodiment, at least one sealing spike 510 extends in a circular ring along an outer perimeter of the liner hanger 505. A seal object 520 may comprise a wavy shape, as shown in FIG. 5B. The seal object 520 having a wavy or curvy shape may more easily expand elastically than a non-wavy shape to be installed about the at least one sealing spike. The at least one sealing spike 510 may be positioned in a seal recess, similar to recess 215 and the seal object 520 will include an opening or slot in one side thereof, similar to opening 225 of seal object 220. The seal object 520 may comprise metal and the metal seal will be straightened during expansion without suffering excessive plastic strain that could possibly reduce its sealing performance.

Example Operations

Figure 6:
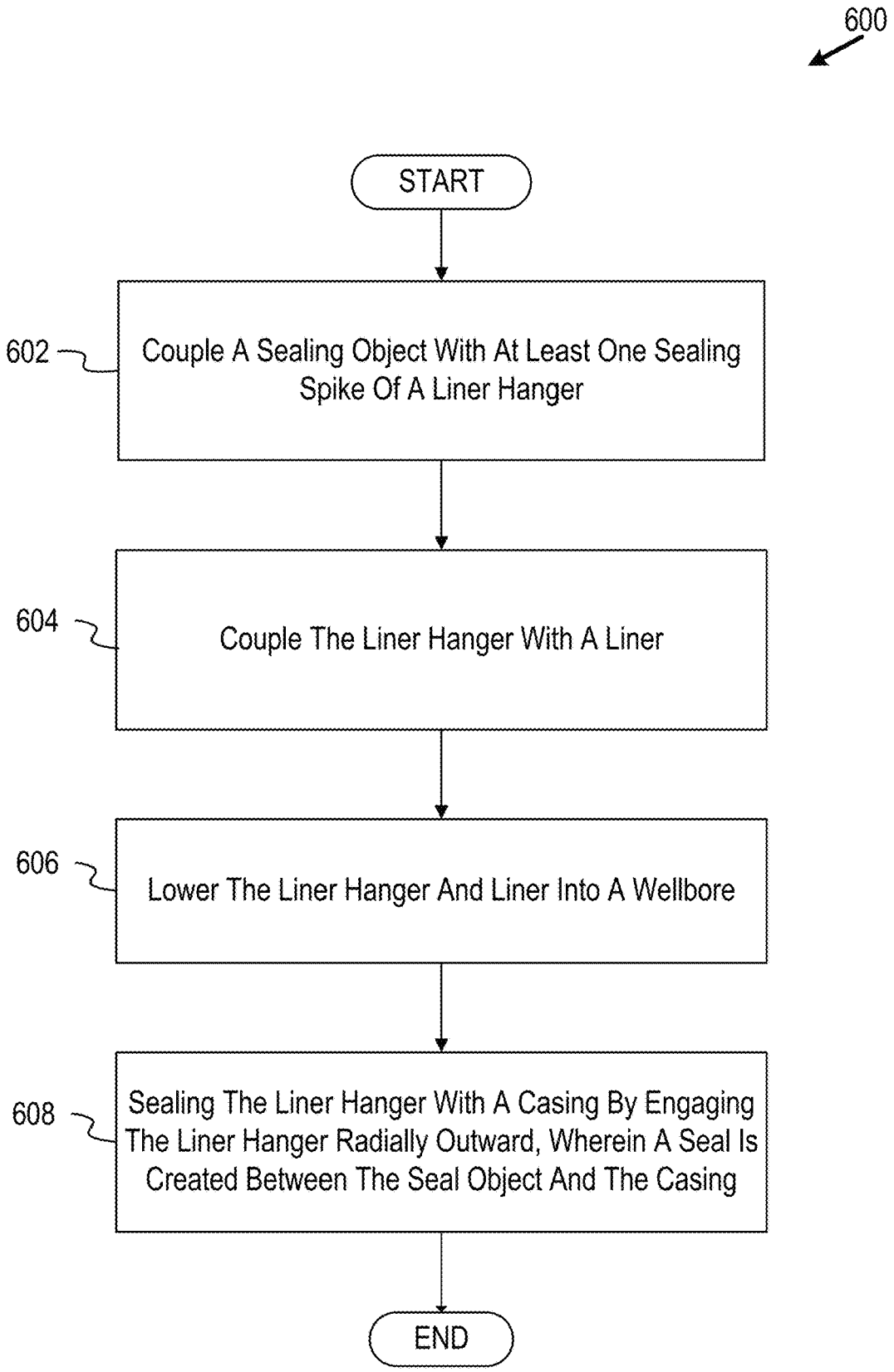
FIG. 6 is a flowchart illustrating a method of installing a liner hanger system into a wellbore, according to some embodiments.

FIG. 6 is a flowchart illustrating one example of a method 600 of installing a liner hanger apparatus into a wellbore. At a block 602, a seal object is coupled with at least one sealing spike of a liner hanger.

As illustrated in FIG. 2A-2D and 3A-3C, an outer diameter of the at least one sealing spike includes a seal recess for housing the seal object, which will form a seal with the casing when the liner hanger is hanging on/engages with the casing. The seal object may be installed into the seal recess of the sealing spike in various ways. In some embodiments, a metal seal may be manufactured in a wavy shape as shown in FIG. 5A-5B and coupled about the at least one sealing spike. The seal object may also be substantially hollow, as shown in FIG. 2A-D, and the seal object in FIG. 5A-5B may also be hollow. The seal object may be stretched and placed into the seal recess in some examples. The amount of stretch needed to pull the still hollow metal may be about 0.1-0.2%. In other embodiments, the seal object may be heated by 100-200C to slide the metal seal object into the recess. Other embodiments may include making a metal ID flush with a top opening of the recess and force the seal object into the recess. Some embodiments of the seal may have an out of plane buckle to a shape like the wavy seal object of FIG. 5A-5B, and in other examples, the seal recess may be a dove tail shaped seal recess will need to hold the seal object in place, such as wires in a foldable bag or hat.

Another way the seal object may be installed into the seal recess or coupled with the at least one sealing spike may include installing a seal object that is round and having a closed cross-section (such as metal hollow o-ring) using an open-ended wire with proper cross section, and yoke, or clamp type connection which is used for connection and disconnection of the two ends of the seal object. The more pull of the connection, the tighter the seal. As an example, this type of connection is similar to those used in a scuba diving low pressure inflator.

At a block 604, the liner hanger is coupled to a liner. At a block 606, the liner hanger and the liner are lowered downhole into a wellbore.

At a block 608, the liner hanger is sealed with the casing by engaging the liner hanger radially outward, wherein the seal is created between the seal object and the casing as a setting tool is run downhole within the liner hanger. The setting tool pushes the liner hanger radially outward to engage the spikes and at least one spike of the linger hanger with the casing. Annular pressure from within the wellbore exerted on the at least one sealing spike of the liner hanger energizes a seal object, thereby creating a seal between the liner hanger and the casing.

While the aspects of the disclosure are described with reference to various implementations and exploitations, it will be understood that these aspects are illustrative and that the scope of the claims is not limited to them. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

The flowcharts are provided to aid in understanding the illustrations and are not to be used to limit the scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

Example Embodiments

Aspects disclosed herein include:

Aspect A: An apparatus comprising: a liner hanger to be positioned within a wellbore, wherein the liner hanger comprises, at least one spike to secure the liner hanger to a casing within the wellbore, wherein an outer diameter of the at least one spike includes a seal recess; and a seal object to be positioned in the seal recess to form a seal with the casing when the liner hanger is hanging on the casing.

Aspect B: A system comprising: a liner to be positioned in a wellbore; and a liner hanger to be coupled with the liner, wherein the liner hanger comprises, at least one spike to secure the liner hanger to a casing within the wellbore, wherein an outer diameter of the at least one spike includes a seal recess; and a seal object to be positioned in the seal recess to form a seal with the casing when the liner hanger is hanging on the casing.

Aspect C: method comprising: coupling a seal object with at least one spike of a liner hanger, the at least one spike to secure the liner hanger to a casing within a wellbore; wherein an outer diameter of the at least one spike includes a seal recess; and wherein the seal object forms a seal with the casing when the liner hanger is hanging on the liner; coupling the liner hanger with the liner; lowering the liner hanger and the liner downhole into a wellbore; and securing the liner hanger to the casing using the at least one spike to create a seal between the seal object and the casing.

Aspects A, B, and C may have one or more of the following additional elements in combination:

Element 1: wherein the seal object is hollow; Element 2: wherein the seal object comprises at least one opening to introduce annular pressure from within the wellbore into the seal object; Element 3: wherein the annular pressure from within the wellbore is anticipated from below the liner hanger and wherein the at least one opening of the seal object faces toward downhole end of the wellbore after the seal object is positioned in the seal recess; Element 4: wherein the annular pressure from within the wellbore is anticipated from above the liner hanger and the at least one opening of the seal object faces toward an uphole end of the wellbore after the seal object is positioned in the seal recess; Element 5: wherein the seal object comprises an O-ring; Element 6: wherein the seal object is metallic; Element 7: wherein the seal recess includes an inner recess surface that is to face opposite of the surface of the liner to which the seal is to be formed, wherein the inner recess surface has an angled slope; Element 8: wherein the seal recess includes an inner recess surface that is to face opposite of the surface of the liner to which the seal is to be formed, wherein the seal recess comprises a dovetail shape such that a length of the inner recess surface is greater than a length of an opening of the seal recess; Element 9: wherein the at least one spike comprises an upper sloping end that is to be positioned at an upper end of the wellbore and a lower sloping end that is to be positioned at a lower end of the wellbore, wherein a width of the lower sloping end is greater than a width of the upper sloping end; Element 10: wherein the at least one spike extends in a circular ring along an outer perimeter of the liner hanger, wherein the seal object comprises an O-ring having a wavy form; Element 11: wherein a shape of the seal object comprises at least one of a C shape, an X shape, an E shape, or a K shape. Element 12: wherein the seal object is hollow, wherein the seal object comprises at least one opening to introduce annular pressure anticipated from within the wellbore into the seal object, and wherein the at least one opening of the seal object faces toward an end of the wellbore from which the annular pressure is anticipated after the seal object is positioned in the seal recess; and Element 13: wherein the seal object is positioned in a seal recess of the at least one spike, wherein the seal object is hollow and comprises at least one opening to introduce annular pressure anticipated from within the wellbore into the seal object, and wherein the at least one opening of the seal object faces toward an end of the wellbore from which the annular pressure is anticipated after the seal object is positioned in the seal recess.

The invention claimed is:

1. An apparatus comprising:

a liner hanger to be positioned within a wellbore, wherein the liner hanger comprises, at least one spike to secure the liner hanger to a casing within the wellbore, wherein an outer diameter of the at least one spike includes a seal recess; and a seal object positioned in the seal recess, the seal object configured to move within the seal recess and configured to form a seal with the casing when the liner hanger is hanging on the casing, wherein the seal object has a hollow interior, wherein the seal recess includes an inner recess surface that faces opposite of the surface of the casing to which the seal is to be formed, wherein the inner recess surface has an angled slope greater than zero relative to the surface of the casing.

2. The apparatus of claim 1, wherein the seal object comprises at least one opening, the opening configured to introduce annular pressure from within the wellbore into the seal object, and wherein the seal object is configured to be energized by the annular pressure.

3. The apparatus of claim 2, wherein the annular pressure from within the wellbore is anticipated from below the liner hanger and wherein the at least one opening of the seal object faces toward downhole end of the wellbore after the seal object is positioned in the seal recess.

4. The apparatus of claim 2, wherein the annular pressure from within the wellbore is anticipated from above the liner hanger and the at least one opening of the seal object faces toward an uphole end of the wellbore after the seal object is positioned in the seal recess.

5. The apparatus of claim 2, wherein the at least one opening of the seal object is smaller in size than any internal dimension of the hollow interior.

6. The apparatus of claim 1, wherein the seal object comprises an O-ring.

7. The apparatus of claim 1, wherein the seal object is metallic.

8. The apparatus of claim 1, wherein the seal recess comprises a dovetail shape such that a length of the inner recess surface is greater than a length of an opening of the seal recess.

9. The apparatus of claim 1, wherein the at least one spike comprises an upper sloping end that is to be positioned at an upper end of the wellbore and a lower sloping end that is to be positioned at a lower end of the wellbore, wherein a width of the lower sloping end is greater than a width of the upper sloping end.

10. The apparatus of claim 1, wherein the at least one spike extends in a circular ring along an outer perimeter of the liner hanger, wherein the seal object comprises an O-ring having a wavy form.

11. The apparatus of claim 1, wherein a shape of the seal object comprises at least one of a C shape, an X shape, an E shape, or a K shape.

12. The apparatus of claim 1, wherein the seal recess has an outer surface opening that is different in width than an inner surface opening.

13. A system comprising:

a liner to be positioned in a wellbore; and a liner hanger to be coupled with the liner, wherein the liner hanger comprises, at least one spike to secure the liner hanger to a casing within the wellbore, wherein an outer diameter of the at least one spike includes a seal recess; and a seal object positioned in the seal recess, the seal object configured to move within the seal recess and configured to form a seal with the casing when the liner hanger is hanging on the casing, wherein the seal object has a hollow interior, wherein the seal recess includes an inner recess surface that faces opposite of the surface of the casing to which the seal is to be formed, wherein the inner recess surface has an angled slope greater than zero relative to the surface of the casing.

14. The system of claim 13, wherein the seal object comprises at least one opening configured to introduce annular pressure anticipated from within the wellbore into the seal object, and wherein the at least one opening of the seal object faces toward an end of the wellbore from which the annular pressure is anticipated after the seal object is positioned in the seal recess, and wherein the seal object is configured to be energized by the annular pressure.

15. The system of claim 14, wherein the at least one opening of the seal object is smaller in size than any internal dimension of the hollow interior.

16. The system of claim 13, wherein the seal object comprises an O-ring.

17. The system of claim 13, wherein the seal object is metallic.

18. A method comprising:

coupling a seal object with at least one spike of a liner hanger, the at least one spike to secure the liner hanger to a casing within a wellbore;

wherein an outer diameter of the at least one spike includes a seal recess in which the seal object is positioned; and wherein the seal object forms a seal with the casing when the liner hanger is hanging on a liner, wherein the seal object has a hollow interior and is configured to move within the seal recess, wherein the seal recess includes an inner recess surface that faces opposite of the surface of the casing to which the seal is to be formed, wherein the inner recess surface has an angled slope greater than zero relative to the surface of the casing;

coupling the liner hanger with the liner;

lowering the liner hanger and the liner downhole into a wellbore; and securing the liner hanger to the casing using the at least one spike to create a seal between the seal object and the casing.

19. The method of claim 18, wherein the seal object comprises at least one opening configured to introduce annular pressure anticipated from within the wellbore into the seal object through the at least one opening, wherein the seal object is energized by the annular pressure, and wherein the at least one opening of the seal object faces toward an end of the wellbore from which the annular pressure is anticipated after the seal object is positioned in the seal recess, and wherein the seal recess comprises a dovetail shape such that a length of the inner recess surface is greater than a length of an opening of the seal recess.

20. The method of claim 18, wherein the seal object comprises a metallic O-ring.

* * * * *